US005943786A

United States Patent [19]

Stahley

[11] Patent Number: 5,943,786

[45] Date of Patent: Aug. 31, 1999

[54] CONTAINER DRYING DEVICE

[76] Inventor: Laura D. Stahley, 3956 E. 800 North, Rolling Prairie, Ind. 46371

[21] Appl. No.: 09/220,946

[22] Filed: Dec. 24, 1998

[51] Int. Cl.[6] ..... F26B 25/00

[52] U.S. Cl. ..... 34/106; 34/104; 34/437; 211/41.3; 392/383

[58] Field of Search ..... 34/104, 106, 107, 34/524, 235, 237, 437; 211/41.3, 71, 74; 392/382, 383

[56] References Cited

U.S. PATENT DOCUMENTS

| | | | |
|---|---|---|---|
| 2,197,178 | 4/1940 | Gates | 34/569 |
| 3,571,939 | 3/1971 | Paul | 34/275 |
| 4,200,993 | 5/1980 | Blanc et al. | 34/104 |
| 4,812,621 | 3/1989 | Brotherton et al. | 392/382 |
| 5,119,943 | 6/1992 | Hoang | 211/41.3 |
| 5,337,498 | 8/1994 | Smith | 34/487 |
| 5,469,635 | 11/1995 | Lamontagne et al. | 34/104 |

*Primary Examiner*—Henry Bennett
*Assistant Examiner*—Pamela A. Wilson

[57] ABSTRACT

A container drying device for quickly drying containers such as glasses, bottles, jars, and mugs. The container drying device includes an air blower with intake and an output with an elongate conduit fluidly connected to the output of the air blower. The conduit is outwardly extended from the air blower over a base. At least one tubes is upwardly extended from the conduit. The tube has an open upper end and a plurality of spaced apart side apertures. A tray is disposed around the tube.

8 Claims, 2 Drawing Sheets

CONTAINER DRYING DEVICE

BACKGROUND OF THE INVENTION

1. Field of the Invention

The present invention relates to container drying devices and more particularly pertains to a new container drying device for quickly drying containers such as glasses, bottles, jars, and mugs.

2. Description of the Prior Art

The use of container drying devices is known in the prior art. More specifically, container drying devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 2,197,178 by Gates; U.S. Pat. No. 5,119,943 by Hoang; U.S. Pat. No. 4,812,621 by Brotherton et al.; U.S. Pat. No. 5,337,498 by Smith; Des. U.S. Pat. No. 272,669 by Lutzker; and U.S. Pat. No. 3,571,939 by Paul.

While these devices fulfill their respective, particular objectives and requirements, the aforementioned patents do not disclose a new container drying device. The inventive device includes an air blower with intake and an output with an elongate conduit fluidly connected to the output of the air blower. The conduit is outwardly extended from the air blower over a base. At least one tubes is upwardly extended from the conduit. The tube has an open upper end and a plurality of spaced apart side apertures. A tray is disposed around the tube.

In these respects, the container drying device according to the present invention substantially departs from the conventional concepts and designs of the prior art, and in so doing provides an apparatus primarily developed for the purpose of quickly drying containers such as glasses, bottles, jars, and mugs.

SUMMARY OF THE INVENTION

In view of the foregoing disadvantages inherent in the known types of container drying devices now present in the prior art, the present invention provides a new container drying device construction wherein the same can be utilized for quickly drying containers such as glasses, bottles, jars, and mugs.

The general purpose of the present invention, which will be described subsequently in greater detail, is to provide a new container drying device apparatus and method which has many of the advantages of the container drying devices mentioned heretofore and many novel features that result in a new container drying device which is not anticipated, rendered obvious, suggested, or even implied by any of the prior art container drying devices, either alone or in any combination thereof.

To attain this, the present invention generally comprises an air blower with intake and an output with an elongate conduit fluidly connected to the output of the air blower. The conduit is outwardly extended from the air blower over a base. At least one tubes is upwardly extended from the conduit. The tube has an open upper end and a plurality of spaced apart side apertures. A tray is disposed around the tube.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new container drying device apparatus and method which has many of the advantages of the container drying devices mentioned heretofore and many novel features that result in a new container drying device which is not anticipated, rendered obvious, suggested, or even implied by any of the prior art container drying devices, either alone or in any combination thereof.

It is another object of the present invention to provide a new container drying device which may be easily and efficiently manufactured and marketed.

It is a further object of the present invention to provide a new container drying device which is of a durable and reliable construction.

An even further object of the present invention is to provide a new container drying device which is susceptible of a low cost of manufacture with regard to both materials and labor, and which accordingly is then susceptible of low prices of sale to the consuming public, thereby making such container drying device economically available to the buying public.

Still yet another object of the present invention is to provide a new container drying device which provides in the apparatuses and methods of the prior art some of the advantages thereof, while simultaneously overcoming some of the disadvantages normally associated therewith.

Still another object of the present invention is to provide a new container drying device for quickly drying containers such as glasses, bottles, jars, and mugs.

Yet another object of the present invention is to provide a new container drying device which includes an air blower with intake and an output with an elongate conduit fluidly connected to the output of the air blower. The conduit is outwardly extended from the air blower over a base. At least one tubes is upwardly extended from the conduit. The tube has an open upper end and a plurality of spaced apart side apertures. A tray is disposed around the tube.

Still yet another object of the present invention is to provide a new container drying device that can air dry several containers at once.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
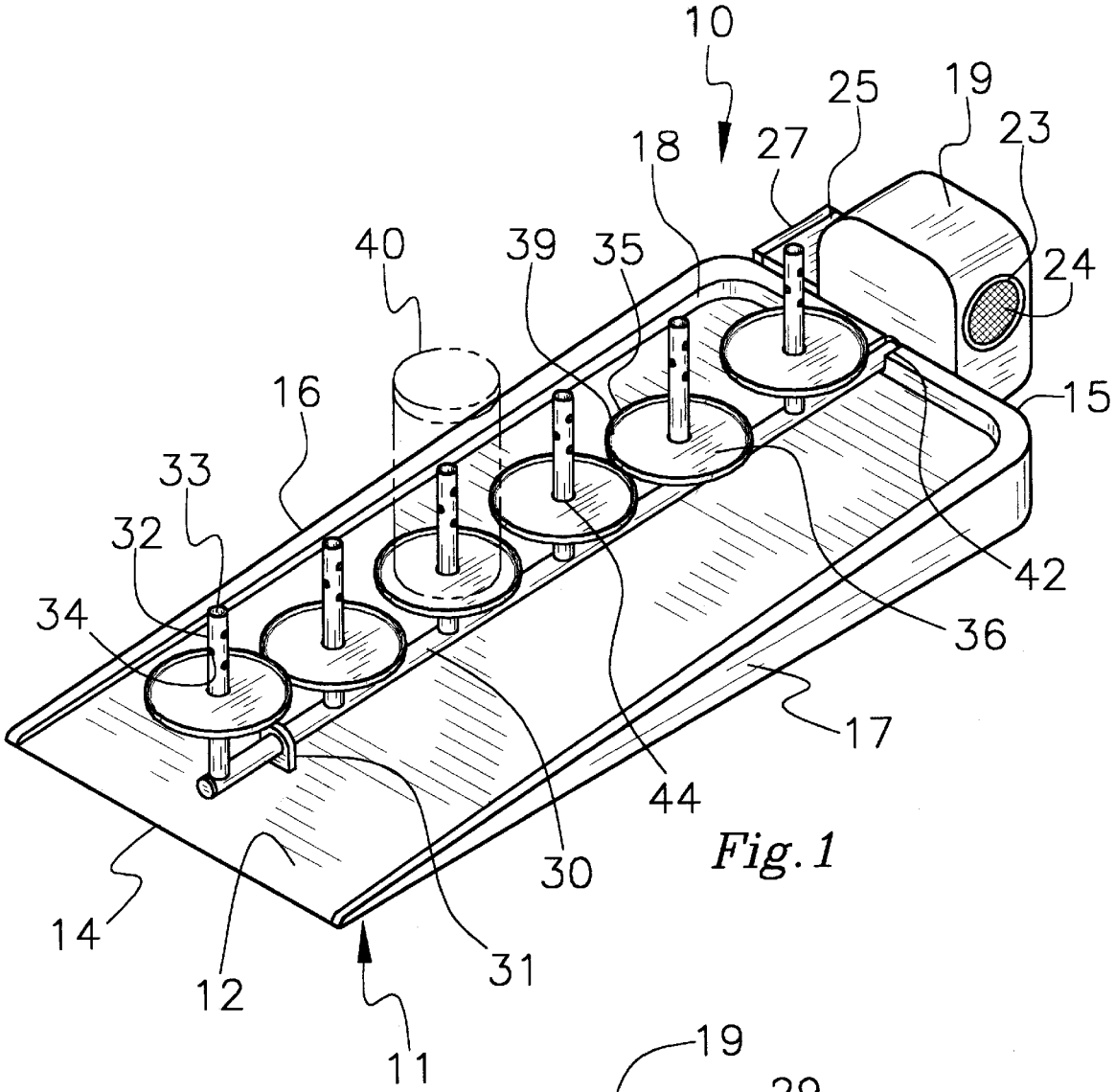
FIG. 1 is a schematic perspective view of a new container drying device according to the present invention.

With reference now to the drawings, and in particular to FIGS. 1 through 5 thereof, a new container drying device embodying the principles and concepts of the present invention and generally designated by the reference numeral 10 will be described.

As best illustrated in FIGS. 1 through 5, the container drying device 10 generally comprises an air blower with intake and an output with an elongate conduit fluidly connected to the output of the air blower. The conduit is outwardly extended from the air blower over a base. At least one tubes is upwardly extended from the conduit. The tube has an open upper end and a plurality of spaced apart side apertures. A tray is disposed around the tube.

In closer detail, the container drying device comprises a base 11 having generally planar rectangular top and bottom faces 12,13, a pair of substantially straight ends 14,15 and a pair of substantially straight sides 16,17 extending between the ends of the base. The top and bottom faces of the base converge together at a first of the ends of the base so that the top and bottom faces lie in planes extending at an acute angle therebetween. Preferably, the acute angle between the top and bottom faces of the base is less than about 45 degrees. Ideally, the acute angle between the top and bottom faces of the base is about 5 degrees. The base also preferably has a generally U-shaped upper lip 18 upwardly extending from the top face of the base along the sides of the base and a second of the ends of the base. In use, the upper lip of the base is designed for directing flow water on the top face of the base towards the first end of the base. The base has a length defined between the ends of the base and a width defined between the sides of the base. Preferably, the length of the base is at least twice the width of the base. Ideally, the length of the base is about 12 inches and the width of the base is about 6 inches.

A housing 19 is coupled to the second end of the base. An air blower 20 is provided in the housing. The air blower has an intake 21 and an output 22. In use, the air blower draws air therein through the intake of the air blower and forces air therein out of the output of the air blower when activated. The housing has a generally circular opening 23 into the intake of the air blower with a mesh screen 24 covering the opening. The mesh screen has a plurality of apertures of a predetermined size to prevent passage of objects greater than the predetermined size through the opening of the housing into the intake of the air blower.

Figure 2:
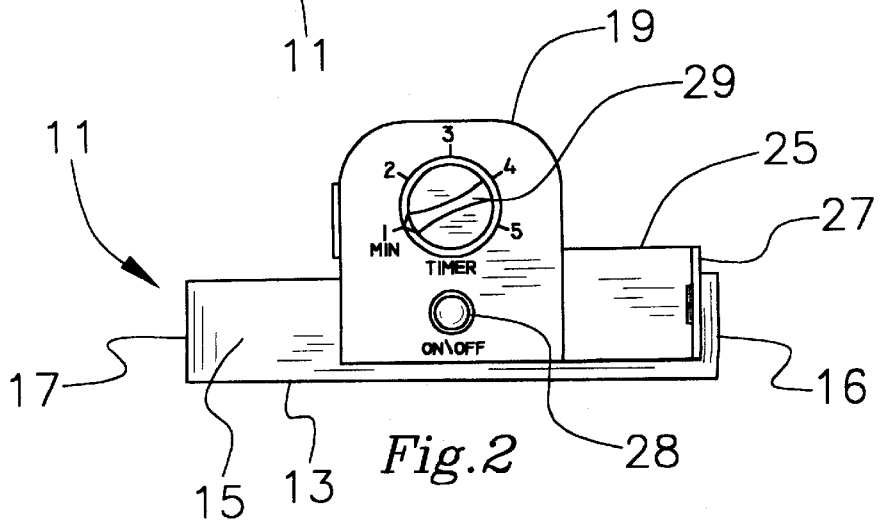
FIG. 2 is a schematic end view of the present invention.
Figure 3:
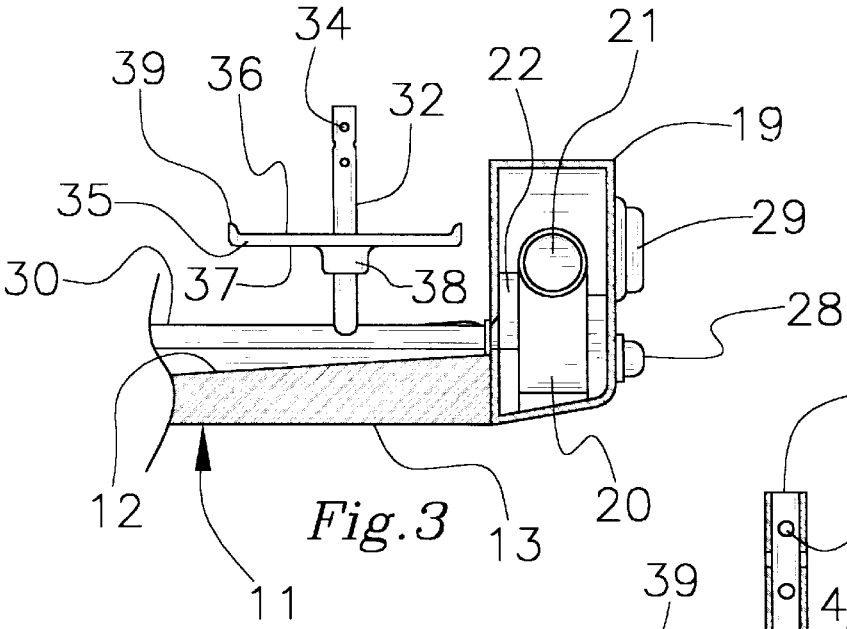
FIG. 3 is a schematic cross sectional view of the area of the present invention around the housing.

The housing preferably also has a secondary compartment 25 separate from the portion of the housing container the air blower. A battery power source 26 is provided in the secondary compartment of the housing. The battery power source is electrically connected to the air blower for providing power to the air blower. The secondary compartment of the housing preferably has an detachable access panel 27 to permit user access into the secondary compartment to permit replacement of the battery power source. A switch is electrically connected to the air blower for selectively activating the air blower. The switch has an actuator 28 mounted on the housing to permit a user to selectively activate the air blower. Preferably, a timer is electrically connected to the air blower to permit selective energizing of the air blower for a predetermined amount of time after the air blower is activated with the switch. The timer has a dial 29 rotatably mounted on the housing for controlling the amount of time the timer activates the air blower based on the amount the dial is rotated. As illustrated in FIG. 2, the housing preferably has indicia around the dial of the time calibrated to indicate minute intervals for the timer to activate the air blower from 1 minute to at least 5 minutes.

An elongate tubular conduit 30 is provided having a pair of opposite ends and a longitudinal axis extending between the ends of the conduit. A first of the ends of the conduit is fluidly connected to the output of the air blower to permit air blown out of the output of the air blower into the conduit. The conduit is outwardly extended from the housing through a break in the upper lip of the base towards the first end of the base. Preferably, the longitudinal axis of the conduit is extended substantially parallel to the sides of the base. In this preferred embodiment, the longitudinal axis of the conduit and the bottom face of the base lie in substantially parallel planes with one another with the longitudinal axis of the conduit extending at an acute angle to the top face of the base. The conduit preferably has a support 31 adjacent a second of the ends of the conduit positioned towards the first end of the base. The support of the conduit is rested on or coupled to the top face of the base to supporting the conduit above the top face of the base.

A plurality of spaced apart elongate tubes 32 are upwardly extended from the conduit. The tubes are extended substantially perpendicular to the longitudinal axis of the conduit and substantially perpendicular to the bottom face of the base. Preferably, the tubes are spaced apart at generally equal intervals along the conduit between the ends of the conduit. The tubes are fluidly connected to the conduit to permit air to pass from the conduit into the tubes. The tubes each have an open upper end 33 and a plurality of spaced apart side apertures 34 to permit passage therethrough of air out of the tubes. The side apertures of each tube are positioned towards the upper end of the respective tube and is staggered at 90 degree intervals around the respective tube.

Figure 4:
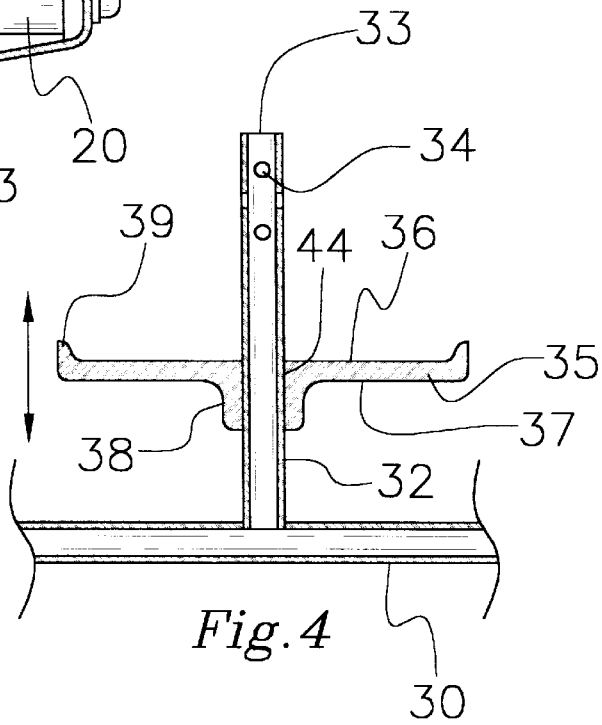
FIG. 4 is a schematic cross sectional view of the area of the present invention around a tube.
Figure 5:
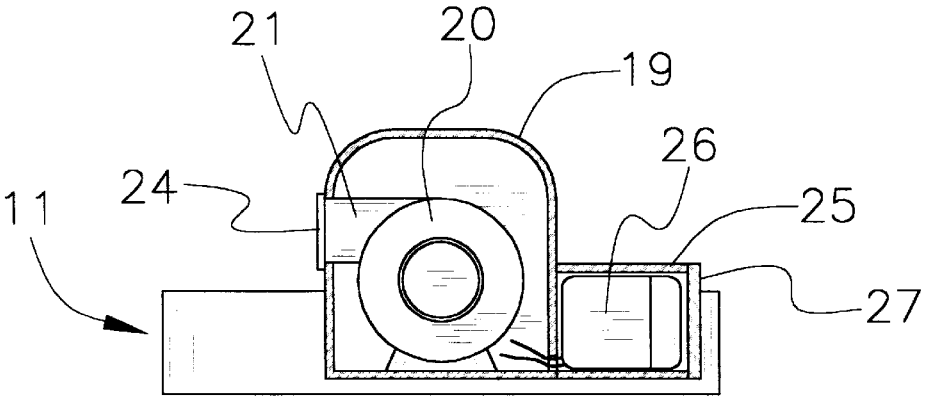
FIG. 5 is another schematic cross sectional view of the present invention around the housing.

Each of the tubes has a generally circular tray 35 disposed therearound with the side apertures of each tube positioned between the upper end of the respective tube and the associated tray. Each of the trays has generally circular upper and lower faces 36,37 and a generally circular center hole therethrough between the upper and lower faces of the respective tray. As illustrated in FIG. 4, each tube is extended through the center hole of the associated tray with each of the trays coupled to the associated tube. Each of the trays preferably has a generally cylindrical extent 38 downwards extending therefrom around the center hole of the respective tray, the extent of each tray is disposed around the associated tube. In use, each of the trays is designed for resting the top of an inverted open-top container 40 on the upper face of the respective tray such that the associated tube extends into the inverted open-top container. Each of the trays also preferably has a generally circular lip 39 upwardly extending around the upper face of the respective tray. In use, the lip of each tray is designed for helping hold a container thereon.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A device for drying open-top containers, comprising:

a base having top and bottom faces which lie in planes extending at an acute angle therebetween, an air blower having an intake and an output;

an elongate conduit having a pair of opposite ends and a longitudinal axis extending between said ends of said conduit;

a first of said ends of said conduit being fluidly connected to said output of said air blower, said conduit being outwardly extended from said air blower over said top face of said base;

at least one tube being upwardly extended from said conduit, said tube being fluidly connected to said conduit;

said tube having an open upper end and a plurality of spaced apart side apertures; and a tray being disposed around said tube.

2. The device of claim 1, wherein said base has a pair of ends and a pair of sides extending between said ends of said base, said top and bottom faces of said base converging together at a first of said ends of said base.

3. The device of claim 2, wherein said base has an upper lip upwardly extending from said top face of said base along said sides of said base and a second of said ends of said base.

4. The device of claim 1, wherein said acute angle between said top and bottom faces of said base is less than about 45 degrees.

5. The device of claim 1, further comprising a housing being coupled to said base, said air blower being provided in said housing.

6. The device of claim 1, wherein said housing has an opening into said intake of said air blower, wherein said housing has a mesh screen covering said opening.

7. The device of claim 1, wherein said tray has a lip upwardly extending around an upper face of said tray.

8. A device for drying open-top containers, comprising:

a base having generally planar rectangular top and bottom faces, a pair of substantially straight ends and a pair of substantially straight sides extending between said ends of said base;

said top and bottom faces of said base converging together at a first of said ends of said base, said top and bottom faces lying in planes extending at an acute angle therebetween;

wherein said acute angle between said top and bottom faces of said base is less than about 45 degrees, wherein said acute angle between said top and bottom faces of said base is about 5 degrees;

said base having a generally U-shaped upper lip upwardly extending from said top face of said base along said sides of said base and a second of said ends of said base;

said base having a length defined between said ends of said base and a width defined between said sides of said base, wherein said length of said base is at least twice said width of said base;

a housing being coupled to said second end of said base;

an air blower being provided in said housing, said air blower having an intake and an output, said air blower drawing air therein through said intake of said air blower and forcing air therein out of said output of said air blower;

said housing having a generally circular opening into said intake of said air blower, said housing having a mesh screen covering said opening, said mesh screen having a plurality of apertures of a predetermined size to prevent passage of objects greater than said predetermined size through said opening of said housing into said intake of said air blower;

said housing having a secondary compartment;

a battery power source being electrically connected to said air blower, said battery power source being provided in said secondary compartment of said housing;

said secondary compartment of said housing having an access panel;

a switch being electrically connected to said air blower, said switch having an actuator mounted on said housing;

a timer being electrically connected to said air blower, said timer having a dial rotatably mounted on said housing;

an elongate conduit having a pair of opposite ends and a longitudinal axis extending between said ends of said conduit;

a first of said ends of said conduit being fluidly connected to said output of said air blower, said conduit being outwardly extended from said housing through a break in said upper lip of said base towards said first end of said base;

said longitudinal axis of said conduit being extended substantially parallel to said sides of said base;

said longitudinal axis of said conduit and said bottom face of said base lying in substantially parallel planes with one another, said longitudinal axis of said conduit being extended at an acute angle to said top face of said base;

said conduit having a support adjacent a second of said ends of said conduit positioned towards said first end of said base, said support of said conduit supporting said conduit above said top face of said base;

a plurality of spaced apart elongate tubes being upwardly extended from said conduit, said tubes being extended substantially perpendicular to said longitudinal axis of said conduit and substantially perpendicular to said bottom face of said base;

said tubes being spaced apart at generally equal intervals along said conduit between said ends of said conduit;

said tubes being fluidly connected to said conduit;

said tubes each having an open upper end and a plurality of spaced apart side apertures;

said side apertures of each tube being positioned towards said upper end of the respective tube;

each of said tubes having a generally circular tray disposed therearound, said side apertures of each tube being positioned between the upper end of the tube and the tray associated with the tube;

each said tray having generally circular upper and lower faces and a generally circular center hole therethrough between said upper and lower faces of the tray;

each tube being extended through said center hole of the tray, each said tray being coupled to the tube;

each said tray having a generally cylindrical extent downwards extending therefrom around said center hole of the respective tray, said extent of each tray being disposed around the associated tube;

each said tray having a generally circular lip upwardly extending around the upper face of the respective tray; and each said tray being adapted for resting the top of an inverted open-top container on the upper face of the respective tray such that the associated tube extends into the inverted open-top container.

* * * * *